US005575060A

United States Patent [19]

Ohta et al.

[11] Patent Number: 5,575,060

[45] Date of Patent: Nov. 19, 1996

[54] TERMINAL INSERTING DRIVE APPARATUS FOR INSERTING TERMINALS ON WIRE

[75] Inventors: Yoshinobu Ohta; Kenichi Taniguchi; Hideo Ohnishi, all of Yokkaichi, Japan

[73] Assignee: Sumitomo Wiring Systems, Ltd., Mie, Japan

[21] Appl. No.: 358,560

[22] Filed: Dec. 14, 1994

[30] Foreign Application Priority Data

Dec. 21, 1993 [JP] Japan ..... 5-321734

[51] Int. Cl.[6] ..... H01R 43/00

[52] U.S. Cl. ..... 29/749; 29/33 M; 29/748

[58] Field of Search ..... 29/33 M, 747, 29/748, 749, 754, 837, 842

[56] References Cited

U.S. PATENT DOCUMENTS 4,729,152 3/1988 Hammond et al. ..... 29/33 M
4,835,844 6/1989 Gerst et al. ..... 29/747
5,157,830 10/1992 Koch ..... 29/748 X
5,208,977 5/1993 Ricard ..... 29/33 M X

FOREIGN PATENT DOCUMENTS 63-174224 7/1988 Japan ..... 29/748
3283285 12/1991 Japan .

*Primary Examiner*—Peter Vo
*Attorney, Agent, or Firm*—Beveridge, DeGrandi, Weilacher & Young LLP

[57] ABSTRACT

The invention provides a terminal inserting drive apparatus for inserting both terminals of a wire into a corresponding terminal cavities in cooperation with a housing carrying apparatus (150). The terminal inserting drive apparatus has a pair of hand sections (1615 and 1616) for, respectively, gripping both ends of the wire (W) with terminals; a conveying section (1611 and 1612) for, individually, conveying the hand sections (1615 and 1616); and a conveying control device (100) for operating the conveying section (1611 and 1612) so as to convey simultaneously both hand sections (1615 and 1616) normally and operating the conveying section (1611 and 1612) so as to convey both hand sections (1615 and 1616) sequentially when both hand sections (1615 and 1616) would interfere with each other.

3 Claims, 7 Drawing Sheets

TERMINAL INSERTING DRIVE APPARATUS FOR INSERTING TERMINALS ON WIRE

TECHNICAL FIELD OF THE INVENTION

The present invention relates to a terminal inserting drive apparatus for inserting terminals on a wire, and more particularly, the present invention relates to a drive apparatus for inserting the terminals which is most suitable for manufacturing a subassembly of a wire harness.

RELATED BACKGROUND ART

Generally, a wire harness is an electric wiring system composed of a plurality of insulative sheathed wires bundled together.

The manufacturing process of the wire harness includes a terminal inserting step for inserting a so-called wire with crimped terminals caulked at both ends thereof (hereinafter referred to as a "wire with terminals") into a connector housing.

The terminal inserting step is conducted by receiving a wire with terminals manufactured in the above step by means of a drive apparatus which includes a terminal inserting mechanism for inserting the terminals into terminal cavities of a connector housing which has been previously arranged and carried in the predetermined direction.

Japanese Laid-Open Patent Publication No. 63-174224 discloses such terminal inserting drive apparatus. The terminal inserting drive apparatus is arranged along a parallel direction of the connector housing, and is provided with a pair of hand sections for gripping the vicinity of both ends of the wire with terminals, a conveying section for conveying the hand section being gripping the wire with terminals to a terminal inserting portion, and a driving section for driving the conveyed hand section in the terminal inserting direction.

Here, the distance in the parallel direction between the terminal cavities corresponding with both terminals fixed to one wire (hereinafter referred to as "juxtapositional distance") does not always correspond to the opposing distance between both hand sections. Therefore, terminals gripped by one hand section and the other hand section cannot be inserted simultaneously. Thus, the prior art employs a method of sequentially inserting both terminals gripped by the respective hand sections into the terminal cavities one by one.

The construction of the respective hand sections is as described in Japanese Laid-Open Patent Publication No. 32-83285.

In order to enhance the efficiency of the terminal inserting step as described above, it is necessary that both hand sections conduct terminal inserting operations simultaneously to the utmost.

However, in the terminal inserting drive apparatus according to the prior art, when the juxtapositional distance of the terminal cavities is different from the opposing distance of the hand sections, both terminals were inserted sequentially one by one, so that the production efficiency was low.

Also, since the respective hand sections in the prior art were integrally conveyed by the conveying section, it became difficult to position when receiving the portion adjacent to the end of the wire with terminals manufactured in the previous step, thereby causing an error in gripping. Such an error in gripping was noticeably arisen in particular when the dimension of the terminals and wire varies much depending on the kind of the wire with the terminal used for one of subassemblies.

Accordingly, what is really needed is a terminal inserting drive apparatus which can be efficiently operated even if the juxtapositional distance of the terminal cavities is different from the opposing distance of the hand sections and can firmly grip the wire with terminals manufactured by the previous step in the desired state when inserting the terminals into the terminal cavities of the connector housing.

DISCLOSURE OF THE INVENTION

The present invention is directed to a terminal inserting drive apparatus for inserting terminals on a wire that satisfies this need.

The present invention is a terminal inserting drive apparatus for inserting terminals crimped to both ends of a wire into corresponding terminal cavities of a connector housing on a housing carrying means which carries the connector housing upon arranging the cavities of the connector housing so as to cooperate with the terminal inserting drive apparatus, comprising:

a pair of hand means for, respectively, gripping portions adjacent to the both ends of the wire with terminals;

a conveying means for, individually, conveying the hand means between a wire receiving position and terminal inserting positions; and a conveying control means for operating the conveying means so as to convey simultaneously both hand means to the terminal inserting positions normally and operating the conveying means so as to convey both hand means sequentially when the terminal inserting positions are located where both hand means would interfere with each other.

According to the above construction, since both terminals crimped to both ends of the wire are independently conveyed, it is possible to set the wire receiving position and wire inserting positions of the respective terminals individually, thereby making it possible to insert the respective terminals gripped to the pair of hand means simultaneously in spite of the juxtapositional distance of the terminal cavities and the opposing distance of the hand means. Moreover, when the terminal inserting position is located where both hand sections would interfere with each other, both hand means are conveyed sequentially. Accordingly, there is an advantage that the terminal inserting operation can be conducted rapidly, thereby completing the terminal inserting step in a short period of time.

It is preferred that the conveying control means permit one of hand means to follow the other hand means at the state where an opposing distance between both hand means is kept at the minimum incollisional distance when one hand means and the other hand means are conveyed sequentially. In that case, when one of hand means is conveyed, the other of hand means can follow to the former hand means with the minimum incollisional distance. Accordingly, there is an advantage that the conveying time can be reduced by the following operation and the working time can be reduced to the utmost even in the sequential inserting operation.

In another aspect of the present invention, there is provided a pair of hand means for, respectively, gripping portions adjacent to both ends of the wire with terminals;

a conveying means for, individually, conveying the hand means between a wire receiving position and terminal inserting positions; and a control means for driving and controlling the conveying means so that the respective hand means can grip the wire with terminals according to inserting strokes of the corresponding terminals.

In this construction, since both terminals crimped to both ends of the wire are conveyed individually, the respective hand means are conveyed so that the gripping position of the wire with terminals is changed according to the inserting stroke of the corresponding terminal. Therefore, there is an advantage that it is possible to conduct the receiving operation while positioning accurately and to adjust the inserting stroke of the terminal when gripping the wire with terminals.

As described above, according to the present invention, the working can be conducted efficiently, when inserting the terminal into the terminal cavity of the connector housing, even if the juxtapositional distance of the terminal cavity is different from the opposing distance of the hand section, and it can be accomplished at the desired state to firmly grip the wire with terminals manufactured by the previous steps.

BRIEF DESCRIPTION OF THE DRAWINGS

By way of example only, specific embodiments of the present invention will now be described, with reference to the accompanying drawings, in which.

DESCRIPTION OF THE PREFERRED EMBODIMENTS

Figure 2:
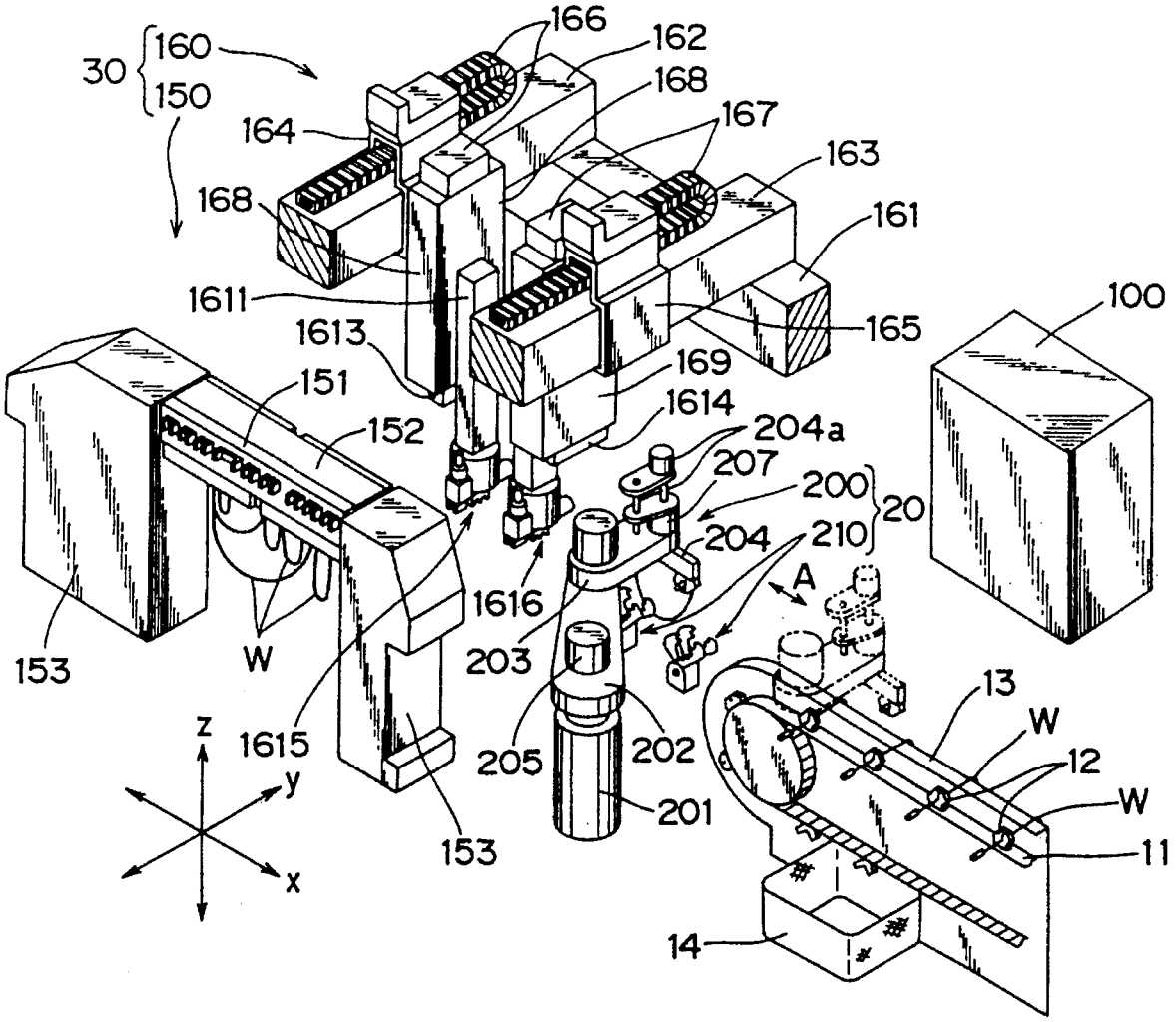
FIG. 2 is a schematic perspective view illustrating an apparatus for producing a subassembly using the terminal inserting mechanism according to the embodiment in FIG. 1.

Firstly, referring to FIG. 2, a apparatus for producing a subassembly is provided with a conveyor 11 for conveying a wire with terminals W. A clamp member 12 is fixed to the conveyor 11. The clamp member 12 is arranged in parallel along a conveying direction of the conveyor 11 with a predetermined distance. Portions adjacent to both ends of the wire with terminals W are gripped with the clamp members 12, respectively. The conveyor 11 is covered with a cover 13 at a side section. A middle portion of the wire with terminals W is hung on an upper portion of the cover 13 and is sagged in U-shape.

The wire with terminals W is conveyed through the following steps as shown in FIG. 2: a measuring and cutting step for paying out a wire from a web to cut the wire in a predetermined length and delivering the cut wire to the clamp member 12 of the conveyor 11; a stripping step for stripping tip ends of the measured wire; and a crimping step for caulking crimp terminals to the tip ends of the stripped wire. The above-described steps are disclosed in detail in the specification and drawings (particularly FIG. 1) of U.S. patent application Ser. No. 08/201,188 now U.S. Pat. No. 5,477,607, which has previously been filed by the applicant. In the following explanations, a direction along which the wire with terminals W is conveyed by a conveyor 11 is referred to as a "X-direction", a direction which intersects horizontally to the X-direction is referred to as a "Y-direction" and a direction which intersects perpendicularly to the X- and Y-directions is referred to as a "Z-direction".

Figure 3:
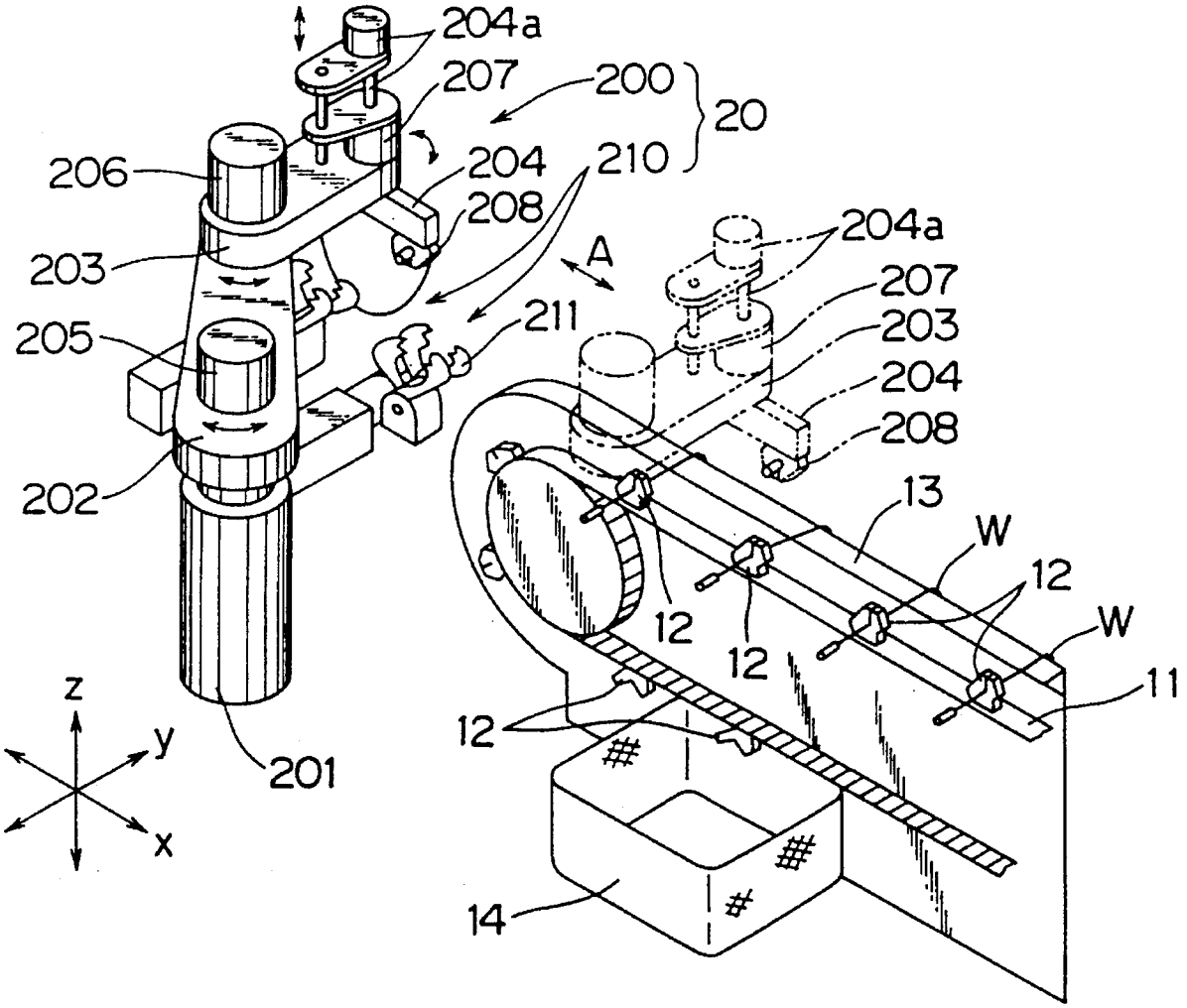
FIG. 3 is a schematic perspective view illustrating a principal portion of a delivering mechanism for supplying the wire with terminals to the terminal inserting mechanism.

Also, referring to FIG. 3, the wire with terminals W clamped by the clamp members 12 of the conveyor 11 is sorted into desired or undesired objects at the downstream end of the conveying direction of the conveyor 11 by means of a known method, and the undesired are contained in a container basket 14 provided at the turning section of the conveyor 11. On the other hand, the desired are conveyed to a terminal inserting mechanism 30 by a delivering mechanism 20 which will be described below.

As is shown clearly in FIG. 3, the delivering mechanism 20 is provided with a conveying section 200 and a receiving section 210.

The conveying section 200 is provided with a main body 201 having a substantially cylindrical appearance. A first arm section 202 of which a base end is supported rotatably is mounted on an upper end of the main body 201. A tip end of the first arm section 202 rotatably supports a base end of a second arm section 203. A tip end of the second arm section 203 supports a hand section 204. The hand section 204 is connected vertical-movably and rotatably to the second arm section 203 by a pivoting mechanism 204*a*.

The main body 201 has a built-in motor (not shown) of which rotational axis extends vertically. The torque of this motor is transmitted to the first and second arm sections 202 and 203 at a predetermined rotational ratio by a power transmitting member (not shown).

Base ends of the first and second arm sections 202 and 203 and a tip end of the second arm section 203 are provided with electromagnetic clutches 205, 206, and 207, respectively, by which directions of the torque of the motor can be reversed. Therefore, as the motor rotates, the first and second arm sections 202 and 203 enable the hand section 204 to move reciprocatingly along the X-direction as shown in an arrow A.

A pair of gripping claws 208 (only one is shown) are mounted to the hand section 204. The holding claws 208 are opposed to each other with the same distance apart as the opposing distance of the clamp members 12 on the conveyor 11. When the hand section 204 is conveyed to the gripping position shown by the broken line in FIGS. 2 and 3 by reciprocating the first and second arm sections 202 and 203, the holding claws are arranged vertically opposable to neighboring two clamp members 12. By driving the pivoting mechanism 204*a* in this state and lowering the hand section 204 downwards, one wire with terminals W gripped by the clamp members 12 is gripped by the gripping claws 208 so that it can be conveyed to the wire receiving position (the position delivered by the gripping claws 208) shown by the solid line in FIGS. 2 and 3. The gripping position and wire receiving position are as described with respect to the position aiming at the X-direction, and a relation with the Z-direction is neglected.

Next, a receiving section 210 of the delivering mechanism 20 has two pairs of receiving claws 211 provided at the wire receiving position as a main section. The receiving claws 211 is openable and closable according to the delivering operation of the gripping claw 208 and the receiving operation of the hand sections 1615 and 1616 which will be described hereinafter, and can receive the wire with terminals W conveyed by the gripping claw 208 of the conveying section 200.

Next, the wire with terminals W delivered to the receiving section 210 is gripped by a terminal inserting mechanism 30, and the terminals of the wire W are inserted into a predetermined connector housing C by the terminal inserting mechanism 30.

The terminal inserting mechanism 30 is, as clearly shown in FIG. 2 provided with a housing carrying apparatus 150 for carrying the connector housing C (see FIG. 4) to enable insertion of the terminal, and a drive apparatus 160 for inserting the terminals on the wire into the carried connector housing C.

Figure 4:
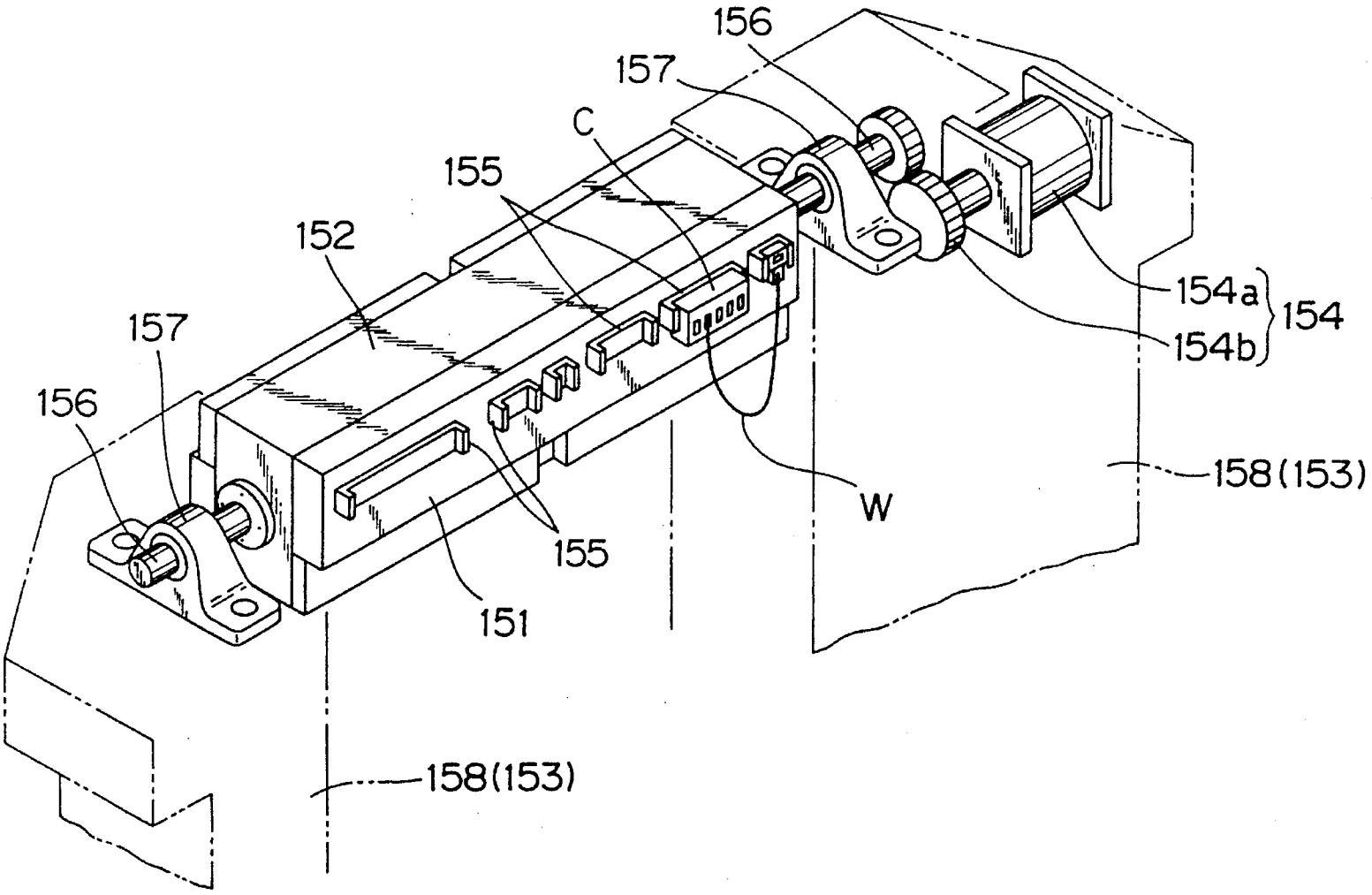
FIG. 4 is a schematic perspective view illustrating a housing carrying apparatus of the terminal inserting mechanism.

Firstly, referring to FIG. 4, the housing carrying apparatus 150 is provided with a terminal inserting board 151, a board mounting member 152 for mounting the terminal inserting board 151, a supporting member 153 for supporting the board mounting member 152 rotatably around the horizontal axis along the X-direction, and a rotation driving section 154 for rotating the board mounting member 152 by half revolution around the horizontal axis at a predetermined timing.

The terminal inserting board 151 is provided for setting a plurality of connector housings C parallel to the horizontal axis with predetermined intervals. The terminal inserting board 151 is provided at the setting positions of the respective connector housings C with positioning jig 155 by which the connector housings C are positioned. Also, in order to fix the positioned connector housing C, the fixing jig (not shown) is mounted to the respective positioning jigs 155.

The board mounting member 152 is a member in a shape of prism along the X-direction. This board mounting member 152 is provided with a pair of surfaces opposing to the Y-direction. The terminal inserting board 151 is mounted detachably to the respective surfaces, with being positioned by a knock pin (not shown). A cylinder (not shown) for driving the fixing jig of the terminal inserting board 152 is mounted on the board mounting member 152.

A support axis 156 is provided projectingly to the board mounting member 152 along the X-direction, and the board mounting member 152 is supported rotatively by the supporting member 153 through the support axis 156 and a bearing 157 for axially supporting the support axis 156.

The supporting member 153 is provided with a pair of supports 158 opposingly provided with a predetermined distance apart in the X-direction therebetween, and the board mounting member 152 is erected between the supports 158.

The supporting member 153 has the built-in rotation drive section 154. The rotation drive section 154 is provided with a rotary actuator 154*a* and a gear unit 154*b* which transmits the torque of the rotary actuator 154*a* to the support axis 156 of the board mounting member 152, whereby driving the board mounting member 152 by half revolution. The rotation drive of this board mounting member 152 is automatically performed at the point where a partial bundling step described hereinafter has been completed. The board mounting member 152 is positioned by a knock pin and the like every time it is driven and rotated every half revolution.

Next, the terminal inserting drive apparatus 160 in this embodiment will be described in detail with reference to FIG. 1.

Figure 1:
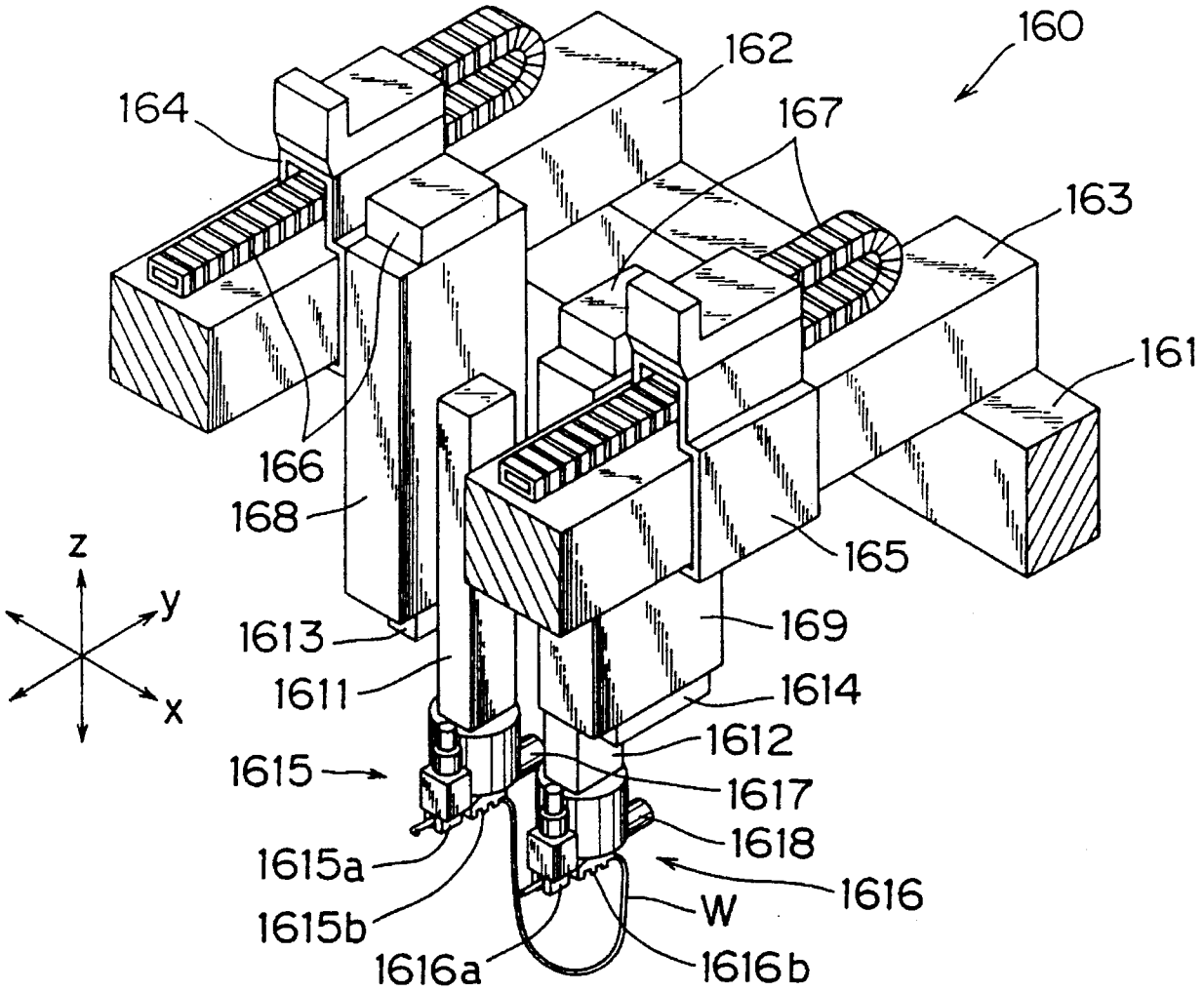
FIG. 1 is a schematic perspective view illustrating a principal portion of the terminal inserting drive apparatus of the terminal inserting mechanism according to one embodiment of the present invention.

The terminal inserting drive apparatus 160 is provided with a pair of first beams 161 (only one is shown in FIG. 1) extending along the X-direction. A pair of second beams 162 and 163 extending in the Y-direction through a roller device (not shown) are erected on the first beam 161, and the respective second beams 162 and 163 are arranged displaceably in the X-direction, individually.

Sliders 164 and 165 formed into a shape of substantially rectangular cylinders are, respectively, mounted to the second beams 162 and 163. The sliders 164 and 165 are arranged movably along the Y-direction by a known reciprocatory transportation device (e.g. cable conveyor mechanism) 166 and 167.

Upper ends of transportation blocks 168 and 169 formed into rectangular cylindrical shape in cross section are fixed to the sliders 164 and 165. The transportation blocks 168 and 169 are connected with leg sections 1611 and 1612, respectively. The leg sections 1611 and 1612 and transportation blocks 168 and 169 are arranged vertically movable along the Z-direction by a known vertical displacement apparatus (e.g. bolt mechanism) 1613 and 1614.

The first and second beams 161, 162, and 163, transportation blocks 168 and 169, leg sections 1611 and 1612 and accessories thereof constitute a principle portion of a conveying section for conveying a pair of hands 1615 and 1616 described hereinafter in this embodiment between the wire receiving position and terminal inserting position, individually.

The hand sections 1615 and 1616 are mounted to a lower end of the leg sections 1611 and 1612. The hand sections 1615 and 1616 are provided with terminal chucks 1615*a* and 1616*a* for gripping terminals on the wire W and wire chucks 1615*b* and 1616*b* for gripping portions adjacent to the terminals of the wire W, respectively. The respective chucks 1615*a*, 1616*a*, 1615*b*, 1616*b* are arranged openably and closably by combining known actuators and cam members.

The respective hand sections 1615 and 1616 are to be driven horizontally along the Y-direction by means of air cylinders 1617 and 1618. Further, by the stroke operation of the air cylinders 1617 and 1618, the terminal of the wire with terminals gripped by the respective hand sections 1615 and 1616 are inserted into the terminal cavity of the connector housing C.

Next, in FIG. 2, a reference numeral 100 is a control device and is composed of a microprocessor or other wire product. The control device 100 is provided for controlling the operation timing and drive amount of the respective driving systems of the apparatus. The control device 100 memorizes standard values corresponding to the respective data (e.g. dimensions of outside diameter, terminal inserting stroke length, etc.) of terminal of the wire with terminals W to be conveyed every subassembly produced. Further, the control device 100 can control the terminal of the wire with terminals to be conveyed by a sensor (not shown) and conduct the control operation described hereinafter as to every terminal.

Hereinafter, operations of the present embodiment will be described.

Figure 5:
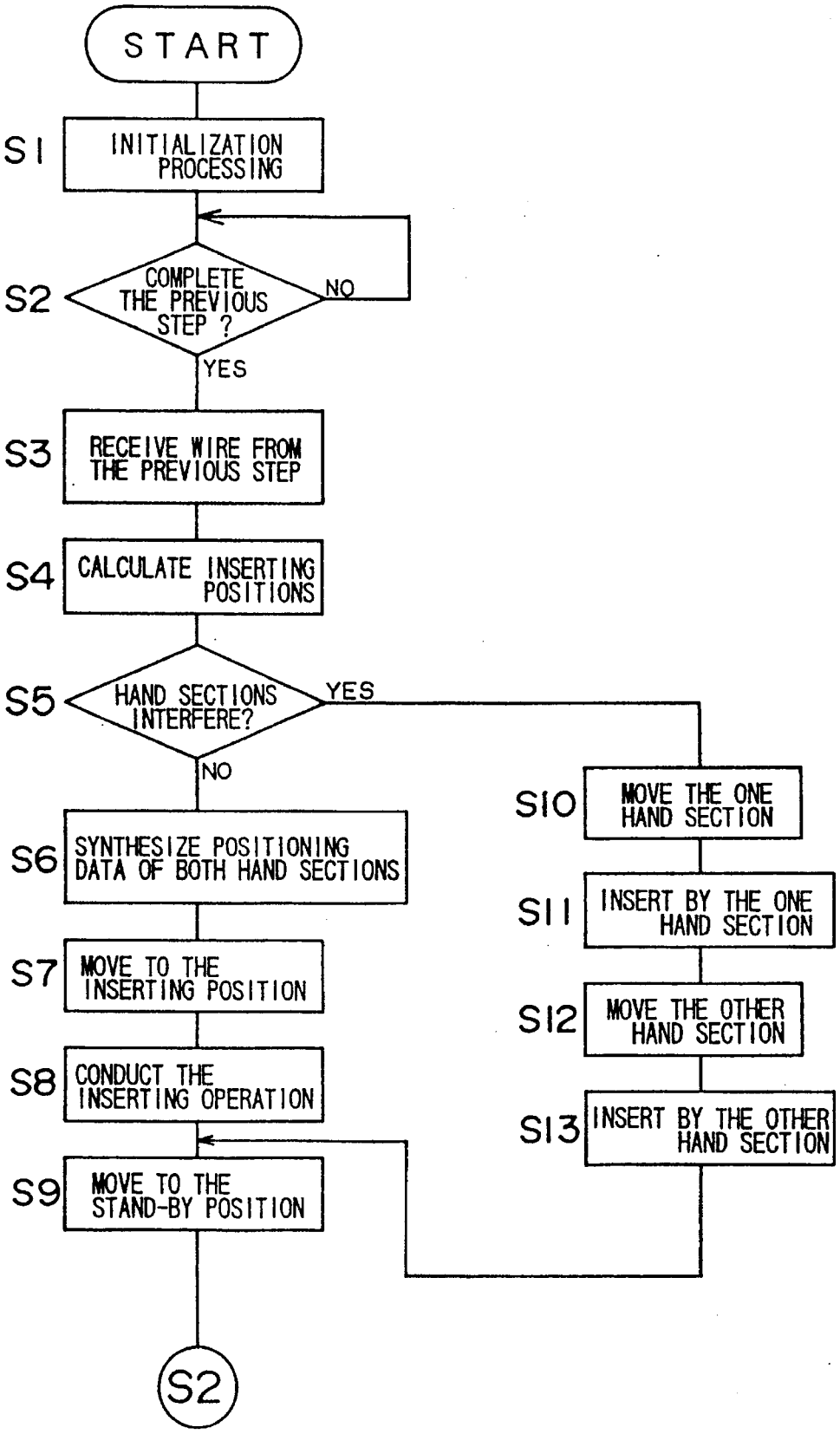
FIG. 5 is a flow chart illustrating a principal operation of the terminal inserting mechanism.

Referring to FIGS. 2 and 5, initialization processing for the whole apparatus is firstly conducted in the step S1. The initialization processing includes a step of setting the respective apparatuses to the predetermined home position and a step of setting of the program memorized in the control device 100 according to the subassembly to be produced.

Next, the judgment is made to determine whether the previous steps have been completed or not in the step S2. Specifically, the conveyor 11 is driven intermittently and while the conveyor 11 is stopped, a measuring and cutting step, a stripping step, a terminal crimping step and a delivering step are conducted simultaneously. Therefore, when aiming at one wire, every time the conveyor 11 intermittently stops, the measuring and cutting step, stripping step, and terminal crimping step are conducted successively and, as shown in FIG. 2, the wire is conveyed to the predetermined gripping position to stop temporarily.

The wire with terminals W which has been conveyed to the predetermined gripping position is picked up by a conveying section 200 of the delivering mechanism 20 and conveyed to the wire receiving position. The wire with terminals W conveyed to the wire receiving position is then passed to a receiving section 210 of the delivering mechanism 20.

Also, in the above step, the predetermined connector housings C are set to the terminal inserting board 151 of the housing carrying apparatus 150 (see FIG. 4).

When it is judged that the above step has been completed in the step S2, while moving to the gripping position in order to grip the next wire with terminals, the terminal inserting drive apparatus 160 of the terminal inserting mechanism 30 moves to the gripping position in the step S3, and the respective hand sections 1615 and 1616 of the terminal inserting drive apparatus 160, grip the portions of the wire with terminals W adjacent to the terminal which are gripped by the receiving section 210 and grip the wire with terminals, thereby allowing the terminal to insert.

Hereinafter, the gripping operation of the wire with terminals W by the terminal inserting drive apparatus 160 will be explained in detail. The respective second beams 162 and 163 move in the direction reverse to the conveying direction of the conveyor 11 along the X-direction to convey the respective hand sections 1615 and 1616 to the wire receiving position. At this time, since the control device 100 can control the movement of the second beams 162 and 163 individually according to terminals to be gripped, the respective hand sections 1615 and 1616 are moved to the wire receiving position, with being positioned individually every terminal. As a result, even when the diameters of the terminals greatly vary, it is possible to firmly grip the terminals on the wire W at the wire receiving position.

Next, the control device 100 of the present embodiment sets the moving distance of the sliders 164 and 165 and every data of the respective terminals and permits the hand sections 1615 and 1616 to move along the Y-direction individually. Thereby, the inserting stroke is adjusted to a desired value every terminal so as to firmly insert the terminal into the connector housing C.

Next, in the step S4, the conveying distances of one hand section 1615 and the other hand section 1616 in the X-direction are calculated, respectively. The calculated conveying distances are used as an interference determination data for the hand sections 1615 and 1616. That is, the minimum incollisional distance which means a distance wherein the respective hand sections 1615 and 1616 do not interfere with each other is previously memorized in the microprocessor of the control device, and the opposing distance is calculated from the conveying distances of both hand sections 1615 and 1616. When the calculated opposing distance is greater than the above minimum incollisional distance, the operation is transferred to a simultaneous inserting step after the step S6 and, when the calculated opposing distance is smaller than the minimum incollisional distance, the operation is transferred to a sequential inserting step after the step S10.

When the operation is transferred to the simultaneous inserting step, the conveying distances of both hand sections 1615 and 1616 are synthesized to obtain a standard coordinate data in the step S6. Based on the standard coordinate data, the hand sections 1615 and 1616 are conveyed to the position where the terminal can be inserted by moving the second beams 162 and 163 relatively along the X-direction simultaneously in the step S7. Thereafter, in the step S8, the positioning in the Y- and Z-directions are conducted and the inserting operation of the terminal is conducted by the above air cylinders 1617 and 1618 (see FIG. 1). This terminal inserting operation is simultaneously conducted and therefore, the terminals at both ends of the wire with terminals W can be inserted in half the time required in the conventional case.

On the other hand, when it is judged that both hand sections 1615 and 1616 are interfered with each other and the operation is transferred to the sequential inserting step, in the step S10, the hand section 1615 for gripping one end of the wire with terminals W (shown in the left side of FIG. 1) is firstly moved based on the conveying distance calculated in the step S4 and is conveyed to the position where the corresponding terminal can be inserted. In this conveying operation, the other hand section 1616 is so conveyed as to follow the one hand section 1615 so that the wire with terminals W may not be stretched between one hand section 1615 and the other hand section 1616. In this following operation, the opposing distance between both hand sections 1615 and 1616 are kept to the minimum incollisional distance in the abovedescribed step S5. Thereby, the terminal can be inserted more rapidly even when the inserting operation is conducted sequentially.

Thereafter, in the step S11, the positioning in Y- and Z-directions are conducted to carry out the inserting operation of the terminal. After the completion of this inserting operation, the hand section 1616 gripping the other end of the terminal is similarly driven alone in steps S12 and S13 to insert the terminal sequentially.

The displacement of the second beams 162 and 163 or transportation blocks 168, 169 can be attained, for example, by stopping the drive by the control device 100 when numbers of the roller device, reciprocatory transportation devices 166 and 167, or vertical displacement devices 1613 and 1614, which are counted by a counting means such as a rotary encoder, reach to predetermined values.

When the step S8 or S13 has been completed, the operation returns to the step S2 through the step S9 in which the hand sections 1615 and 1616 move to the stand-by position until the manufacturing process of the product is completed, and the above operations are repeated.

Figure 6:
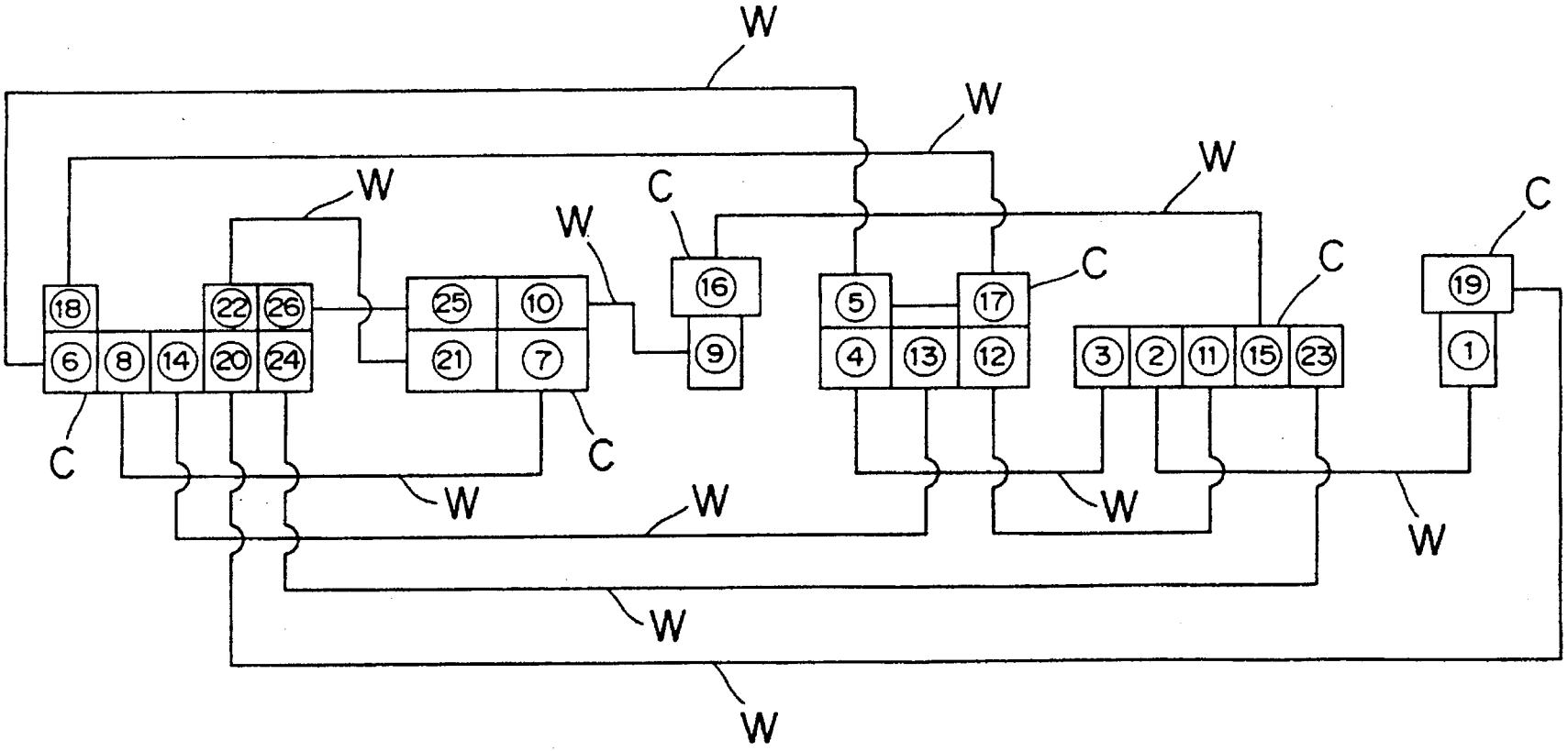
FIG. 6 is a schematic view illustrating the case where thirteen wires with terminals are connected to six kinds of connector housings by employing the above embodiment.
Figure 7:
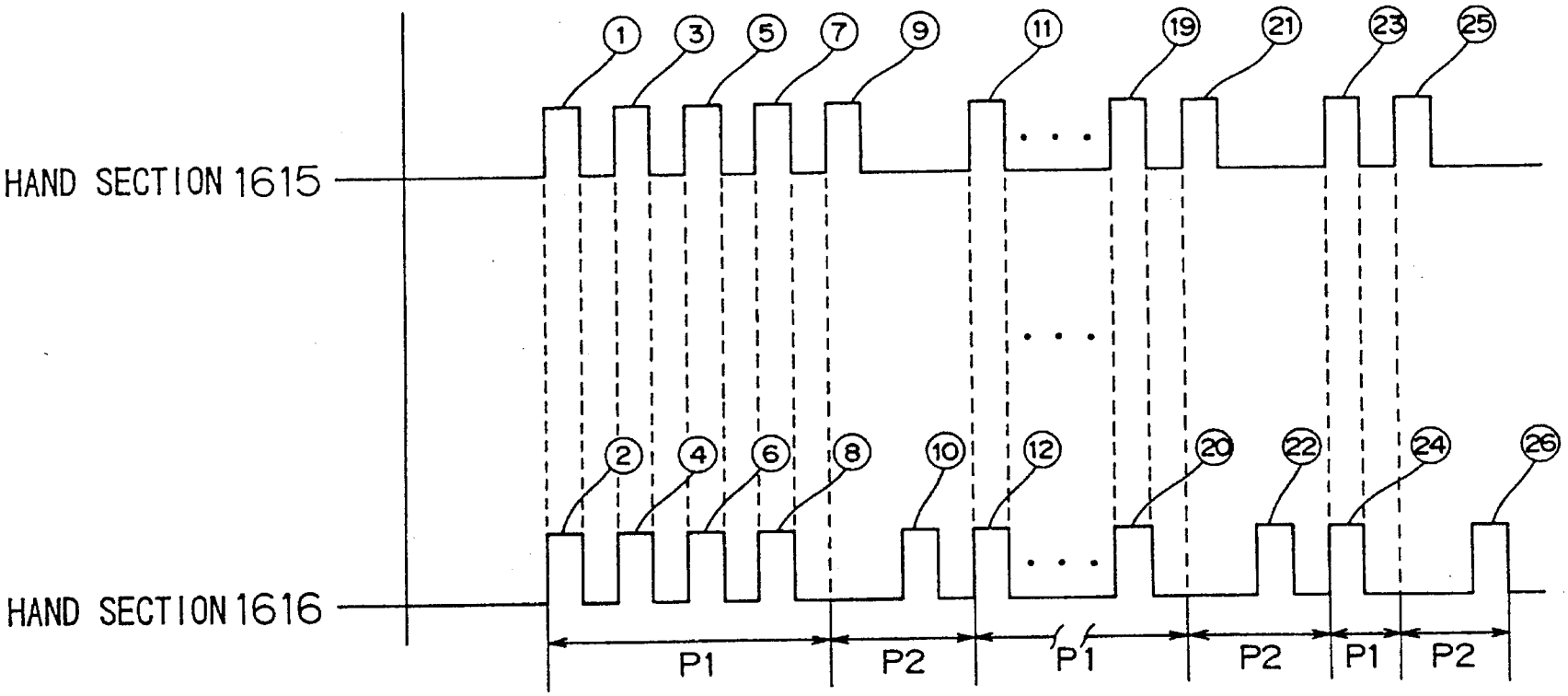
FIG. 7 is a simplified time chart illustrating the inserting operation of the hand section according to the embodiment in FIG. 6.

FIG. 6 is a schematic view illustrating the case where thirteen wires with terminals are connected to six kinds of connector housings C by employing the above embodiment, and FIG. 7 is a simplified time chart illustrating the inserting operation of the hand sections 1615 and 1616 according to the embodiment in FIG. 6.

In FIG. 6, the terminal cavities of the respective connector housings C are shown by circled numbers. Also, the numbers show that the terminals are inserted in the order of low number.

In the embodiment shown in FIG. 6, the respective terminal inserting positions where the terminals are respectively inserted into the ninth and tenth, twenty first and twenty second, and twenty fifth and twenty sixth cavities correspond to the position where both hand sections 1615 and 1616 are interfered with each other, respectively. Accordingly, regarding other terminal cavities, i.e. first to eighth, eleventh to twentieth, and twenty third and twenty forth terminal cavities, the simultaneous inserting step is selected in the step S5 of FIG. 5 and the simultaneous insertion of the terminals are conducted as described above. As a result, as shown by the portion P1 in FIG. 7, both terminals can be inserted simultaneously, thereby making it possible to complete the insertion of the terminals in half the time in comparison with a conventional apparatus.

On the other hand, regarding the terminal cavities wherein the terminals are respectively inserted into the ninth and fifteenth, twenty first and twenty second, twenty fifth and twenty sixth cavities, the sequential terminal inserting steps after the step S10 are used (see the portion P2 in FIG. 7). As a result, it is possible to complete the terminal inserting step smoothly without causing mutual interference of both hand sections 1615 and 1616.

As described above, according to the present embodiment, it is possible to insert both terminals gripped by a pair of hand sections 1615 and 1616 simultaneously, regardless of the juxtapositional distance of the terminal cavity and opposing distance of hand sections 1615 and 1616. Therefore, there is an advantage that the terminal inserting operation can be conducted rapidly, thereby completing the terminal inserting step in a short period of time.

Particularly, according to the present embodiment, the other hand section 1616 is so conveyed as to follow at the incollisional state when one hand section 1615 is conveyed. Therefore, there is an advantage that the conveying time can be reduced by the following time and the working time can be reduced to the utmost even in the sequential inserting operation.

Further, as mentioned in the explanation of operations of the step S3 of FIG. 5, since the respective hand sections 1615 and 1616 are conveyed so that the gripping position of the wire with terminals W may be changed according to the inserting stroke of the corresponding terminal, there is an advantage that it is possible not only to conduct receiving operation while positioning accurately but also to adjust the inserting stroke of the terminal when gripping the wire with terminals.

As described above, according to the present embodiment, the working can be conducted efficiently when inserting the terminal into the terminal cavity of the connector housing C even if the juxtapositional distance of the terminal cavity is different from the opposing distance of the hand sections 1615 and 1616, and it can be accomplished to firmly grip the wire with the terminal which has been subjected to the previous step at the desired state.

The above embodiments are taken as only examples for clearly showing technical details of the invention, and the invention should not be understood narrowly as being limited to the embodiments alone. Hence, the spirit and scope of the invention are limited only by the attached claims.

What is claimed is:

1. A terminal inserting drive apparatus for inserting terminals crimped to both ends of a wire into corresponding terminal cavities of a connector housing, on a housing carrying means which carries the connector housing, upon arranging the cavities of the connector housing along an axis so as to cooperate with the terminal inserting drive apparatus, said drive apparatus comprising:

a pair of hand means for, respectively, gripping portions adjacent to both ends of the wire with terminals;

a conveying means for, individually, conveying said hand means between a wire receiving position and different terminal inserting positions located along said axis; and a conveying control means for operating said conveying means so as to convey both said hand means along said axis to a first set of two different terminal inserting positions simultaneously when said first two different positions are located such that both said hand means would not interfere with each other as said conveying means conveys said hands to said two positions, and sequentially conveying both said hand means along said axis to a second set of two different terminal inserting positions when said second set of two different terminal inserting positions are located such that both said hand means would interfere with each other if said hand means were conveyed simultaneously.

2. A terminal inserting drive apparatus according to claim 1, wherein said conveying control means permits one of said hand means to follow the other of said hand means such that an opposing distance between both said hand means is a minimum incollisional distance when one hand means and said other hand means are conveyed sequentially.

3. A terminal inserting drive apparatus according to claim 1, wherein said control means drives said conveying means so that said hand means each can grip the wire with terminals according to inserting strokes of the corresponding terminals.

* * * * *